US009004956B2

(12) United States Patent
Wu et al.

(10) Patent No.: US 9,004,956 B2
(45) Date of Patent: Apr. 14, 2015

(54) CONDUCTING WIRE TERMINAL SEAT

(71) Applicant: Switchlab Inc., New Taipei (TW)

(72) Inventors: Chih-Yuan Wu, New Taipei (TW); Su-Hui Lian, New Taipei (TW)

(73) Assignee: Switchlab Inc., New Taipei (TW)

( * ) Notice: Subject to any disclaimer, the term of this patent is extended or adjusted under 35 U.S.C. 154(b) by 53 days.

(21) Appl. No.: 13/898,636

(22) Filed: May 21, 2013

(65) Prior Publication Data

US 2014/0349528 A1 Nov. 27, 2014

(51) Int. Cl.

| | |
|---|---|
| ***H01R 4/36*** | (2006.01) |
| ***H01R 4/34*** | (2006.01) |
| ***H01R 4/48*** | (2006.01) |
| ***H01R 12/51*** | (2011.01) |
| *H01R 11/12* | (2006.01) |

(52) U.S. Cl.

CPC ..... *H01R 4/34* (2013.01); *H01R 4/4818* (2013.01); *H01R 11/12* (2013.01); *H01R 12/515* (2013.01)

(58) Field of Classification Search

CPC ..... H01R 4/34; H01R 4/36; H01R 4/363; H01R 4/4845; H01R 9/24

USPC ..... 439/709, 797, 798, 801, 810, 813, 814, 439/834

See application file for complete search history.

(56) References Cited

U.S. PATENT DOCUMENTS

| | | | | |
|---|---|---|---|---|
| 4,174,147 | A * | 11/1979 | Waddington et al. | 439/636 |
| 4,630,882 | A * | 12/1986 | Naylor et al. | 439/444 |
| 5,595,505 | A * | 1/1997 | Duke et al. | 439/630 |
| 7,014,514 | B2 * | 3/2006 | Zahnen | 439/798 |
| 7,404,745 | B1 * | 7/2008 | Wu | 439/811 |
| 7,559,810 | B1 * | 7/2009 | Wu | 439/801 |
| 7,607,955 | B2 * | 10/2009 | Hill et al. | 439/798 |
| 7,618,299 | B2 * | 11/2009 | Ferretti | 439/814 |
| 7,988,504 | B2 * | 8/2011 | Stromiedel | 439/809 |
| 8,105,118 | B2 * | 1/2012 | Claprood, Jr. | 439/709 |
| 8,485,852 | B2 * | 7/2013 | Wu | 439/814 |

* cited by examiner

*Primary Examiner* — Thanh Tam Le

(74) *Attorney, Agent, or Firm* — Rosenberg, Klein & Lee

(57) ABSTRACT

A conducting wire terminal seat comprises a main body which includes a first body and a second body. The first and second bodies respectively have a chamber for allowing an entry of high and low current (or voltage) conducting wires which is then electrically connected to metal units in respective chambers. A height (or length) of the first body is larger than a height (or length) of the second body, so that a distance from the first body to an operating area is smaller than a distance from the second body to the operating area. Therefore, the operator operates the loading and unloading operation of the high and low current conducting wires under a safer circumstance.

17 Claims, 3 Drawing Sheets

CONDUCTING WIRE TERMINAL SEAT

BACKGROUND OF THE INVENTION

1. Field of the Invention

The present invention relates to a terminal device allowing electrical conducting wires to be inserted therein and connected thereto, in particular to a terminal seat that assembles the high and low current (or voltage) conducting wires at the same time, so that the operator operates the loading and unloading operation of the high and low current conducting wires under a safer circumstance.

2. Description of the Related Art

The conventional technique applies a metal component (or called a contact) covered in an insulator, which is normally made of plastic, to press or connect with conducting wires that enter the terminal seat, thereby forming an electrically-connected connecting or pressing terminal device. Therefore, an electrically connecting device of electric appliances or mechanical equipments is built.

This type of connecting terminal seat utilized for being inserted into the circuit board such as PCB comprises a terminal seat housing. The housing includes a plurality of inserting holes and through holes, so that the conducting wires connected to the mechanical equipments are inserted into the housing. The housing further includes a chamber for assembling the metal component so as to contact with or be electrically connected to the conducting wires which is inserted in the housing.

Concretely, the outer side of the conducting wire is covered with an insulated layer made of a plastic material. The front side of the conducting wire includes a length of bare wire. When the conducting wire is inserted into the housing, most of the insulated layer is set in the first hole, so that the bare wire of the front side of the conducting wire contacts with the metal component disposed in the terminal seat, or is gripped by the metal component slightly. Therefore, the bare wire is not disconnected from the metal easily. The bare wire will not be disconnected from the metal component unless the operator utilizes a tool or a screwdriver to stretch in the housing and push the metal component. The metal component has a thinner or narrower pin formed in symmetry so as to be inserted on the circuit board or mutually inserted with another pin of another connecting terminal. Basically, this type of conducting wire is usually applied to the terminal device which transmits lower current (or voltage).

Another type of conducting wire is applied to higher current (or voltage). Due to the steadiness of the electrical connection of the higher current (or voltage) conducting wire, the terminal seat, and the metal component, the operation status is more complicated. The bare wire of the front side of the conducting wire is connected to a conductible Y-shaped metal joint. After the Y-shaped joint inserted in the terminal seat assembling with screws, the operator is allowed to operate the screw to grip the Y-shaped joint of the conducting wire in order to form an electrical connection with the metal component.

The above-mentioned structure, operation, and application of the conventional assemblage of the conducting wire and the terminal seat utilize the terminal device of the conducting wire with low-current (or voltage) or high-current (or voltage) conducting wires to be disposed separately in order to reduce the danger while operating the electrical connection. As the people who are familiar with the conventional technique have known, we do not expect that the operation and the application reflect a demand of a larger operating area and a higher cost while co-operating the high and low current (or voltage) conducting wires with the terminal device.

The reference information shows the technique of assemblage of the insulator of the conducting wire terminal seat and the conducting wire, the contact, or the metal component. If the insulator of the terminal seat is redesigned to be assembled with conducting wires which have different current (or voltage), the structure thereof will be different from the conventional structure, so that the operating status is changed. Furthermore, the application will also be improved for maintaining the entire stability and the grip ability and reducing the cost and operating area of the terminal device to be as low as possible. The inventor discovered an ideal assemblage of conducting wire terminal seat and the conducting wire which should comprise the following subjects:

1. Conquer or improve the above-mentioned technique under the consideration of the operator's safety.
2. Provide a terminal seat device for allowing staff to simply assemble the low-current and the high-current conducting wires with the terminal seat device at the same time and reducing the cost and operating area of the conventional terminal seat device so as to increase the applicability of the terminal seat device.

These subjects have not been disclosed in the reference information.

SUMMARY OF THE INVENTION

It is an object of the present invention to provide a conducting wire terminal seat, which comprises a main body. The main body includes a first body and a second body. The first body and the second body respectively have at least one chamber for allowing high and low current (or voltage) conducting wire to enter the respective chambers so as to be electrically connected with the metal unit disposed in the chamber. The height (or length) of the first body is larger than a height (or length) of the second body, so that a distance from the first body to an operating area is smaller than a distance from the second body to the operating area. Therefore, the operator operates the loading and unloading operation of the high and low current conducting wires under a safer circumstance.

In the preferred embodiment of the present invention, the specification of the high-current (or voltage) conducting wire is over 50-volt voltage to the ground, and the low-current (or voltage) conducting wire is under 50-volt voltage to the ground.

According to the conducting wire terminal seat, the chamber of the first body includes a fixing portion, such as a screw, and a spacer connecting to a metal unit disposed in the chamber of the first body. A front side of the high-current conducting wire is connected to a Y-shaped metal joint. The Y-shaped joint is allowed to be inserted between the fixing portion, the spacer and the metal unit and fixed by the fixing portion so as to be electrically connected to the metal unit in the chamber of the first body. The metal unit has a thinner or narrower pin stretched out of the chamber of the first body for being inserted on the circuit board or mutually inserted with another pin of another connecting terminal.

According to the conducting wire terminal seat of the present invention, the metal unit of the chamber of the second body includes an elastic conductor. The metal unit is formed into a C-shaped contour (in cross section) and has a pin perpendicularly protruded therefrom for being inserted in the circuit board or mutually inserted with another pin of another connecting terminal. The elastic conductor is formed into an L-shaped contour (in cross section) and allows the conducting wire to be inserted between the metal unit and the elastic conductor for forming an electrical connection. A groove is disposed at the top side of the metal unit for allowing the operator to press the elastic conductor by a tool in order to disconnect the conducting wire from being pressed by the elastic conductor.

DETAILED DESCRIPTION OF THE PREFERRED EMBODIMENTS

Figure 1:
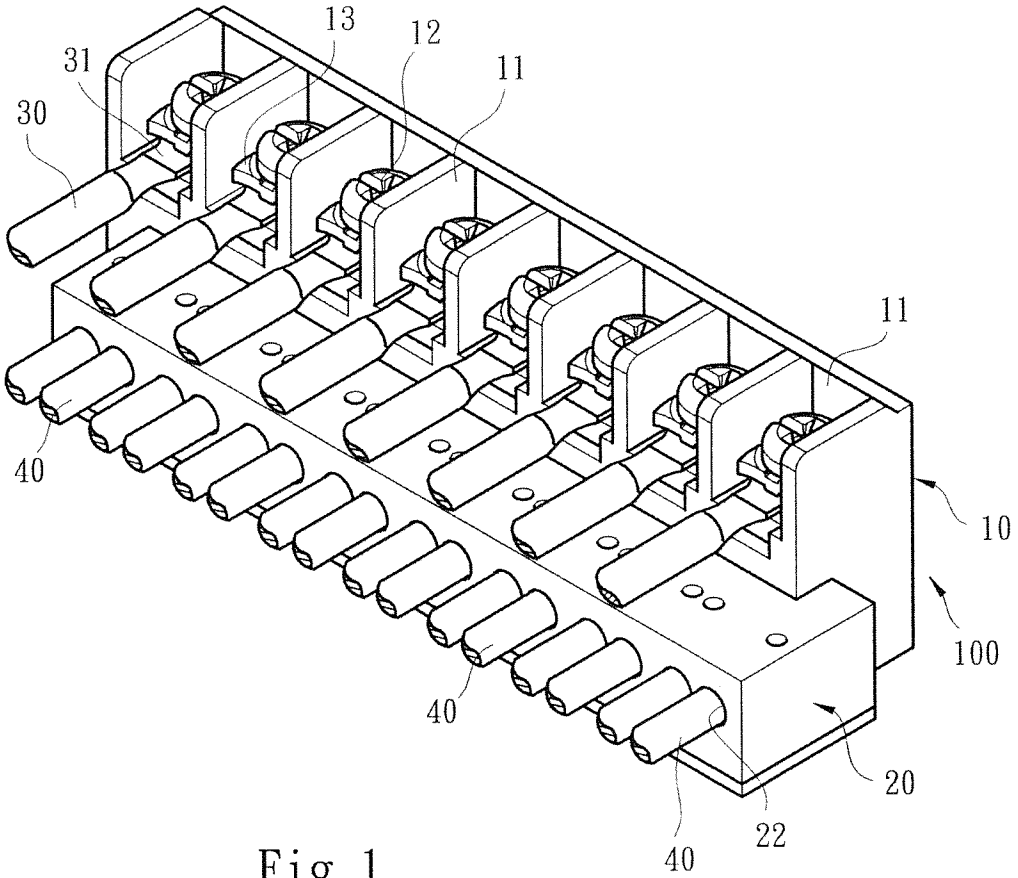
FIG. 1 is a schematic view showing an assemblage of a terminal seat and the conducting wires of the preferred embodiment of the present invention and an assemblage of a first body and a second body.
Figure 2:
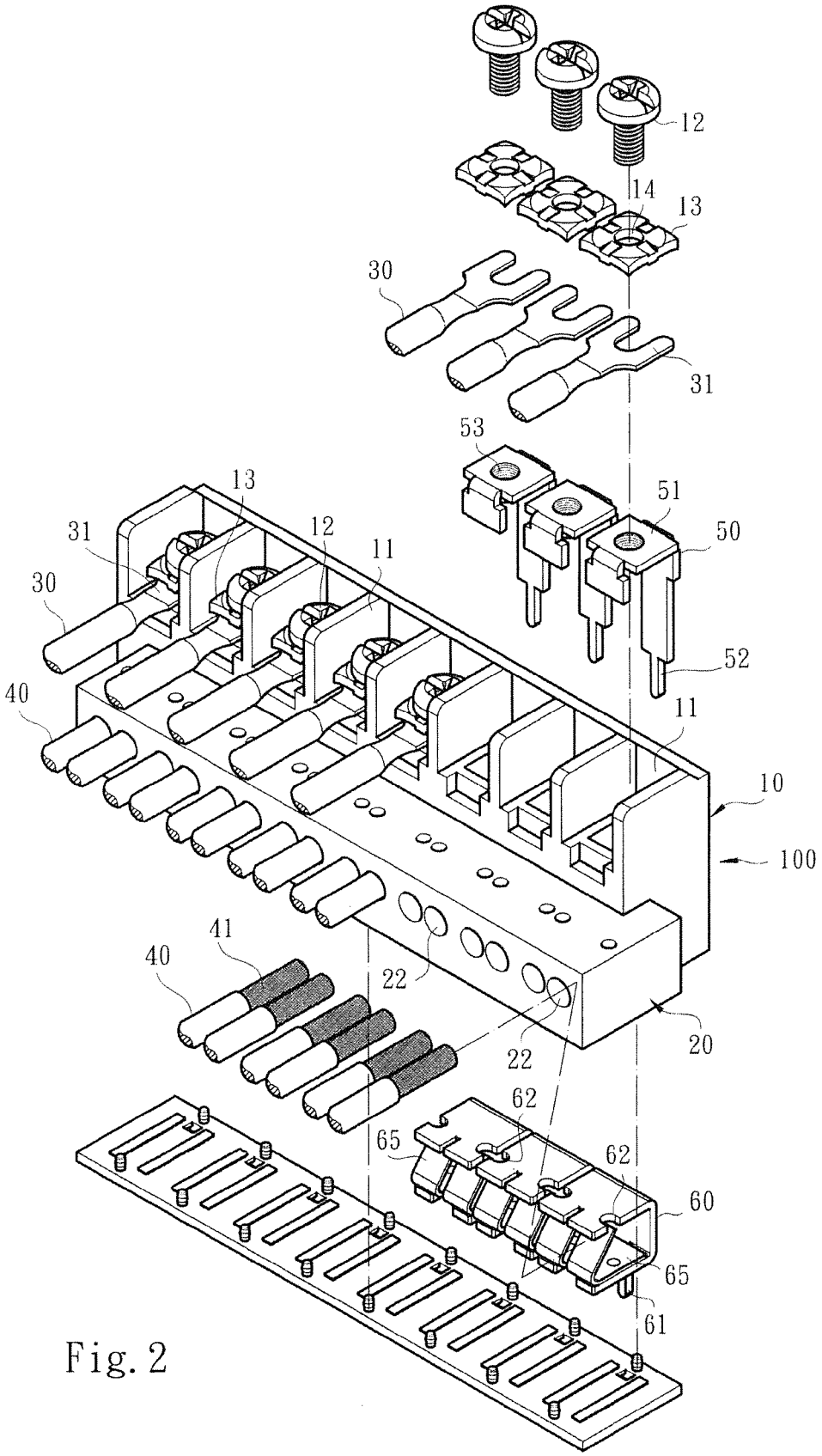
FIG. 2 is an exploded view showing another point of view in FIG. 1.
Figure 3:
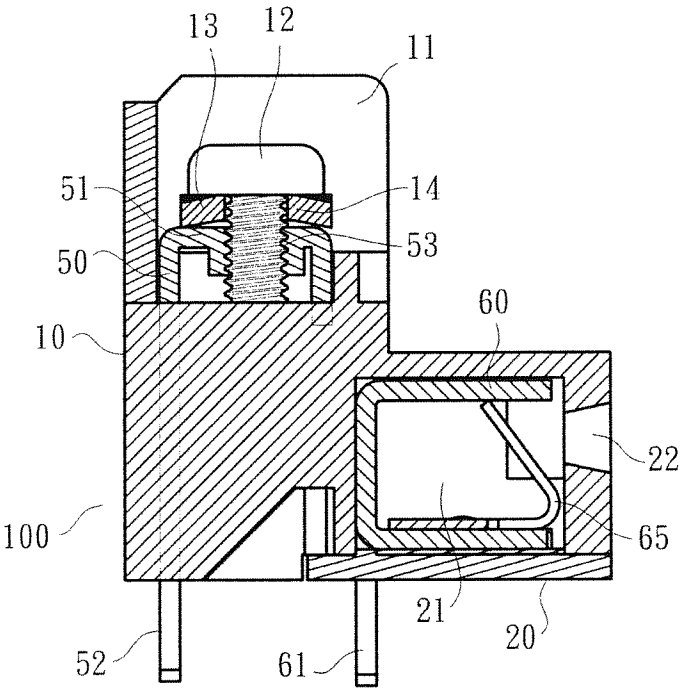
FIG. 3 is a section view showing a terminal seat of the present invention.

Referring to FIGS. 1, 2, and 3, a conducting wire terminal seat of the present invention is shown. The conducting terminal seat comprises a conducting wire terminal seat (or a pressing wire terminal seat) or a main body made of insulator which is denoted by the reference numerals 100 throughout disclosure. The terminal seat or the main body 100 is usually made of a plastic material and comprises a first body 10 and a second body 20 connected to the first body 10. Referring to FIG. 3, the second body 20 is disposed below the first body 10. The first body 10 and the second body 20 respectively include at least one chamber 11, 21 for allowing a high-current (or voltage) conducting wire 30 and a low-current (or voltage) conducting wire 40 to enter the respective chambers 11, 21 which are then electrically connected to a plurality of metal units 50, 60 disposed in the chambers 11, 21.

The preferred embodiment of the present invention shows a specification of the high-current (or voltage) conducting wire 30 being over 50-volt voltage to the ground and a specification of the low-current (or voltage) conducting wire 40 being under 50-volt voltage to the ground.

Referring to FIGS. 2 and 3, a fixing portion 12, such as a screw, and a spacer 13 with a first hole 14 are disposed in the chamber 11 of the first body 10 and connected to the metal unit 50 in the chamber 11 of the first body 10. The metal unit 50 is formed into a 7-shaped contour (in cross section) and includes a carrying portion 51 and a thinner or narrower pin 52 which is stretched out of the chamber 11 of the first body 10 for being inserted on the circuit board or mutually inserted with another pin of another connecting terminal (not shown).

The carrying portion 51 and the pin 52 of the metal unit 50 are perpendicular to each other in the preferred embodiment of the present invention. The carrying portion 51 has a second hole 53 corresponding to the first hole 14 of the spacer 13. The second hole 53 is threaded, so that the fixing portion 12 is able to pass through the first hole 14 of the spacer and the second hole 53 of the carrying portion and fasten to the metal unit 50.

Referring to FIG. 2, a front side of the high-current conducting wire 30 is connected to a Y-shaped metal joint 31. The Y-shaped joint 31 is allowed to be inserted between the fixing portion 12, the spacer 13, and the carrying portion 51 and fixed by the fixing portion 12, so that the high-current conducting wire 30 is electrically connected to the metal unit 50 in the chamber 11 of the first body 10.

Referring to FIGS. 2 and 3, the metal unit 60 in the chamber 21 of the second body 20 includes an elastic conductor 65. The metal unit 60 is formed into a C-shaped contour (in cross section) and has a pin 61 perpendicularly protruded therefrom so as to be inserted in the circuit board or mutually inserted with another pin of another connecting terminal (not shown).

The elastic conductor 65 is an elastic-laminated contact made of a metal material. The elastic conductor 65 is formed into an L-shaped contour (in cross section) and allows the low-current conducting wire 40 to be inserted between the metal unit 60 and the elastic conductor 65 for forming an electrical connection.

At least one conducting hole 22 is disposed at a side of the second body 20 and communicated with the chamber 21. The operator directly operates the low-current conducting wire 40 to be inserted into the chamber 21 via the conducting hole 22, so that a bare wire formed at a front side of the low-current conducting wire 40 is forced to be inserted between the metal unit 60 and the elastic conductor 65 and formed an electrical connection. A groove 62 is disposed at a top side of the metal unit 60 for the operator to press the elastic conductor 65 by a tool in order to disconnect the low-current conducting wire 40 from being pressed by the elastic conductor 65.

Figure 4:
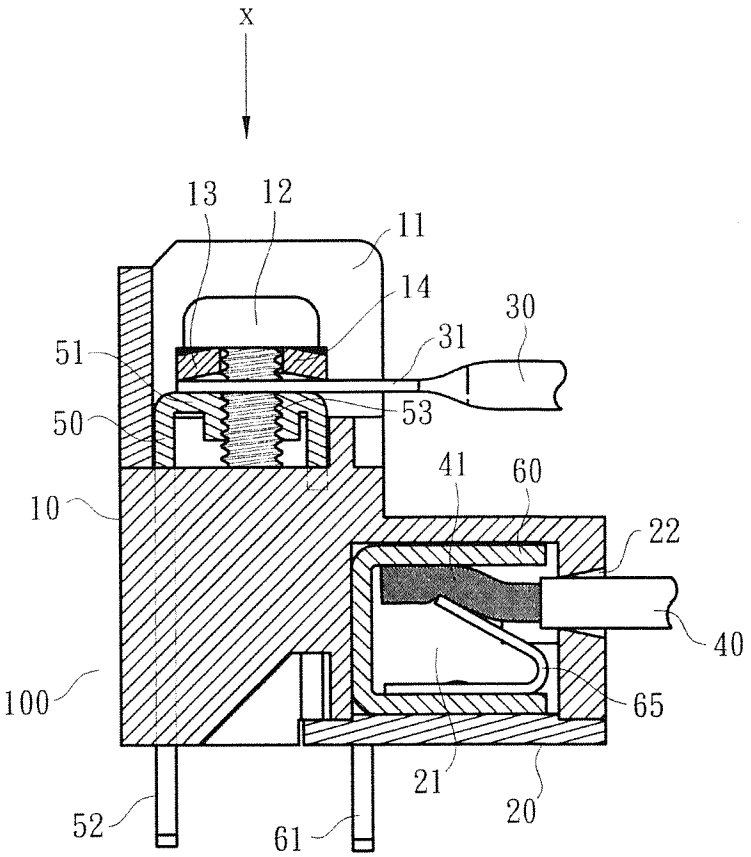
FIG. 4 is a section view showing the assemblage of the first body, the second body, and the conducting wires in FIG. 1.

Referring to FIG. 4, an arrow is assumed to be at the position of an operating area $\chi$, such as the operating position or direction of the tool. The height (or length) of the first body 10 is preferably larger than the height (or length) of the second body 20. That is to say, the distance from the first body 10 to the operating tool or the operating area $\chi$ is smaller than the distance from the second body 20 to the operating tool or the operating area $\chi$, so that the operator operates the loading and unloading operation of the high-current conducting wire 30 and low-current conducting wire 40 under a safer circumstance.

Referring to FIG. 4, a complex structure of the first body 10 and the second body 20 of the terminal seat or the main body 100 is shown. The operator can not only operate the low-current conducting wire 40 to be inserted in the chamber 21 of the second body 20 and pressed by the metal unit 60 and the elastic conductor 65 for forming an electrical connection, but also operate the high-current conducting wire 30 to be inserted in the chamber 11 of the first body 10 and pressed by the fixing portion 12, the spacer 13, and the carrying portion 51 for being electrically connected to the metal unit 50.

The above-mentioned operating mode is considered that the first body 10 and the second body 20 build a complex structure for achieving the conditions of the low-current conducting wire 40 with easier operation, smaller operating area, and less danger, and the high-current conducting wire 30 with harder operation, larger operating area, and higher danger.

A plurality of metal units 50 or 60 are preferably electrically connected with each other in a further preferred embodiment, so that the metal units 50 or 60 share a pin 52 or 61 for transmitting electricity. Therefore, less pins 52 or 61 are disposed on the main body 100 and able to be inserted on the circuit quickly or mutually inserted with another pin of another connecting terminal.

The conducting wire terminal seat comprises the following advantages:

1. The assemblage of the conducting wire terminal seat or the main body 100 and the conducting wires 30, 40 or the metal units 50, 60 is reconsidered and redesigned, so that the structure thereof is different from the prior arts, and the operating status is also different from the prior arts. The terminal seat or the main body 100 is able to be assembled with conducting wires indifferent current or voltage and apparently improve the application and maintains the entire stability and grip ability.

2. Under the condition of providing an operating safety for the operator, the structures of the first body 10 and the second body 20 respectively have a different distance with the operating area $\chi$ for allowing the operator to assemble the lower-current conducting wire 40 and the higher-current conducting wire 30 with the main body 100. Therefore the cost and the operating area of the conventional terminal device are apparently improved at the same time, and the applicability of the terminal seat device is increased.

We claim:

1. A conducting wire terminal seat that receives and retains high voltage wires and low voltage wires, the seat comprising:

a main body, wherein said main body includes a first body and a second body, said first body extending in a longitudinal direction and said second body extending laterally therefrom, said first body including at least a first chamber that receives and retains a high voltage wire, said first chamber having a first metal unit, the first metal unit is engaged with the high voltage wire for electrically and mechanically connecting the high voltage wire to said first metal unit;

said second body being spaced from said first body and being electrically insulated therefrom, said second body including at least a second chamber that receives and retains a low voltage wire, said second chamber receiving a second metal unit for retentively capturing the low voltage wire to electrically and mechanically connect the low voltage wire to said second metal unit;

said first metal unit including a first metal pin extending from a bottom portion of said main body, and said second metal unit including a second metal pin extending from said bottom portion of said main body in laterally spaced relationship to said first metal pin; and a height of said first body being larger than a height of said second body, so that a distance from said first body to an operating area is smaller than a distance from said second body to said operating area.

2. The conducting wire terminal seat that receives and retains high voltage wires and low voltage wires as claimed in claim 1, wherein said second body is disposed below said first body.

3. The conducting wire terminal seat that receives and retains high voltage wires and low voltage wires as claimed in claim 1, wherein a specification of the high voltage wire is over 50-volt voltage to ground.

4. The conducting wire terminal seat that receives and retains high voltage wires and low voltage wires as claimed in claim 1, wherein a fixing portion and a spacer with a first hole are disposed in said first chamber and connected to said first metal unit.

5. The conducting wire terminal seat that receives and retains high voltage wires and low voltage wires as claimed in claim 4, wherein said first metal unit is formed into a 7-shaped contour in cross section, said metal unit having a carrying portion.

6. The conducting wire terminal seat that receives and retains high voltage wires and low voltage wires as claimed in claim 5, wherein a second hole is formed in said carrying portion for allowing said fixing portion to pass through said first hole of said spacer and said second hole of said carrying portion and fasten to said first metal unit.

7. The conducting wire terminal seat that receives and retains high voltage wires and low voltage wires as claimed in claim 6, wherein said second hole is threaded.

8. The conducting wire terminal seat that receives and retains high voltage wires and low voltage wires as claimed in claim 3, wherein a front side of said high-current conducting wire is connected to a Y-shaped joint; a fixing portion and a spacer with a first hole are disposed in said first chamber and connected to said first metal unit, said first metal unit comprises a carrying portion, said Y-shaped joint is inserted between said spacer and said carrying portion and fixed by said fixing portion.

9. The conducting wire terminal seat that receives and retains high voltage wires and low voltage wires as claimed in claim 1, wherein an elastic conductor is disposed in said second metal unit.

10. The conducting wire terminal seat that receives and retains high voltage wires and low voltage wires as claimed in claim 9, wherein said second metal unit is formed into a C-shaped contour in cross section.

11. The conducting wire terminal seat that receives and retains high voltage wires and low voltage wires as claimed in claim 10, wherein said elastic conductor is made of a metal material produced into an elastic electric conductive lamination; said elastic conductor is formed into an L-shaped contour in cross section.

12. The conducting wire terminal seat as claimed in claim 1, wherein a specification of the low voltage wire is under 50-volt voltage to the ground.

13. The conducting wire terminal seat as claimed in claim 12, wherein at least one conducting hole is disposed at a side of said second body and it communicates with said second chamber; the low voltage wire is inserted in said second chamber via said conducting hole, so that a bare wire formed at a front side of the low voltage wire is inserted between said second metal unit and said elastic conductor for forming an electrical connection.

14. The conducting wire terminal seat as claimed in claim 13, wherein a groove is disposed at a top side of said second metal unit.

15. The conducting wire terminal seat as claimed in claim 1, wherein a plurality of said first metal units are disposed in said first chamber; said first metal units are electrically connected with each other; said first metal units share a first metal pin for transmitting electricity.

16. The conducting wire terminal seat as claimed in claim 1, wherein a plurality of second metal units are disposed in said second chamber; said second metal units are electrically connected with each other; said second metal units share a second metal pin for transmitting electricity.

17. The conducting wire terminal seat that receives and retains high voltage wires and low voltage wires as claimed in claim 1, wherein said operating area is an operating place of a tool.

* * * * *